United States Patent [19]

Uozumi

[11] Patent Number: 4,798,488

[45] Date of Patent: Jan. 17, 1989

[54] DOT MATRIX PRINT HEAD

[75] Inventor: Koji Uozumi, Yokohama, Japan

[73] Assignee: NHK Spring Co., Ltd., Kanagawa, Japan

[21] Appl. No.: 48,999

[22] Filed: May 7, 1987

Related U.S. Application Data

[63] Continuation of Ser. No. 769,846, Aug. 26, 1985, abandoned.

[30] Foreign Application Priority Data

Aug. 27, 1984 [JP] Japan ..... 59-178116
Sep. 3, 1984 [JP] Japan ..... 59-184955

[51] Int. Cl.[4] ..... B41J 3/12
[52] U.S. Cl. ..... 400/124; 101/93.05
[58] Field of Search ..... 400/124; 101/93.05; 335/279; 29/602 R, 428

[56] References Cited

U.S. PATENT DOCUMENTS 4,136,978 1/1979 Bellinger ..... 400/124
4,348,120 9/1982 Isobe ..... 400/124
4,389,127 6/1983 Bellinger ..... 400/124
4,411,538 10/1983 Asano ..... 400/124
4,449,836 5/1984 Yamada ..... 400/124
4,513,496 4/1985 Wang ..... 400/124 X
4,652,158 3/1987 Asano ..... 400/124

*Primary Examiner*—Paul T. Sewell
*Attorney, Agent, or Firm*—Albert L. Jeffers; Anthony Niewyk

[57] ABSTRACT

A dot matrix print head in which the mass of the armature is reduced by providing a groove in the armature in the portion where the magnetic flux density is relatively low. The armature may be advantageously attached to a sheet spring by laser welding applied from the bottom surface of the groove without creating craters in the external face of the sheet spring. Reduction in the mass of the armature allows a substantial increase in the print speed of the print head. Use of laser welding reduces the manufacturing cost of the print head and the absence of any craters in the external face of the sheet spring is favorable for the performance of the magnetic circuit of the print head.

3 Claims, 3 Drawing Sheets

11a
11
7
6
10
7
9
8
2a
V
V
1a
4
5
1
6
3
12
2

DOT MATRIX PRINT HEAD

This is a continuation of application Ser. No. 769,846, filed Aug. 26, 1985 now abandoned.

TECHNICAL FIELD

This invention relates to a dot matrix printer and in particular to a dot matrix print head for use in a dot matrix printer which is capable of high speed printing.

BACKGROUND OF THE INVENTION

A number of types of dot matrix print heads are known. A typical dot matrix print head comprises a magnetic gap of a magnetic circuit including a permanent magnet and a solenoid, an armature located in the magnetic gap and supported by spring means, and a wire connected to the armature by way of an arm. Normally, the spring means is biased by the magnetic flux acting upon the armature. The magnetic flux in the magnetic gap may be interrupted by energizing the solenoid and canceling the magnetic flux of the permanent magnet with the magnetic flux of the solenoid, whereby the wire is axially driven towards paper by the restoring force of the spring means. Normally, a plurality of wires are used in a straight row or, alternatively, in a staggered arrangement so as to achieve a desired print by a matrix of wires impacting upon the paper.

Such a print head is generally required to be light in weight so that the print head would not produce excessive inertia force as a carriage carrying the print head travels across the paper. Also, the speed of the reciprocating axial motion of print wires is desired to be as fast as possible for greater printing speed. This may be achieved by increasing the magnetic flux of the magnetic circuit and reducing the effective mass of the assembly including the spring means, the armature, the arm and the wire.

In order to increase the magnetic flux of the magnetic circuit, the permanent magnet must be increased in size and, accordingly, the size of the armature must be increased so as to prevent the saturation of the magnetic flux density in the armature. For instance, U.S. Pat No. 4,389,127 teaches a print head in which a high printing speed is achieved through advantageous structure of a magnetic circuit. However, to ensure sufficient mechanical strength to the sheet spring supporting the armature whose inertia force is substantial, crossed sheet members are used as the spring means. Therefore, the structure of this print head is fairly complex and expensive to manufacture.

U.S. Pat No. 4,225,250 teaches a simple print head using a ring permanent magnet and a plurality of hammers each carrying a print wire at its free end. Since each of the hammers consists only of an inwardly projecting tongue of a sheet spring member and serves the functions of a spring member, an armature and an arm, this print head is highly simple in structure and light in weight. However, absence of an armature with a certain cross sectional area limits the maximum magnetic flux which may be utilized because the thin hammer can carry very limited magnetic flux therethrough, and its printing speed is limited accordingly.

Normally, an armature is brazed to the free end of a sheet spring, but brazing is a fairly expensive process and may not ensure uniform mechanical strength. When the armature is welded to the sheet spring for instance by a laser beam, craters are formed in the surface of the sheet spring facing the first pole surface and cause a substantial magnetic resistance in the interface between the sheet spring surface and the first pole surface.

SUMMARY OF THE INVENTION

In view of such shortcomings of the prior art, a primary object of this invention is to provide a dot matrix print head which is capable of high speed printing and is yet simple in structure.

Another object of this invention is to provide a dot matrix print head which is easy to manufacture and highly durable.

According to this invention, such objects are accomplished by providing a dot matrix print head comprising a magnetic circuit including magnetic circuit including a permanent magnet, a magnetic core, a solenoid and a magnetic gap defined by a first pole surface and a pair of second pole surfaces extending orthogonally relatively to the first pole surface, a sheet spring fixed at its one end, an armature fixedly secured to a free end of the sheet spring, an arm connected to the armature, and a wire fixedly attached to the other end of the arm, in such a manner that the wire may be axially driven by the restoring force of the sheet spring by interrupting the magnetic flux by canceling the magnetic flux of the permanent magnet with the magnetic flux of the solenoid, characterized in that the armature is reduced in weight by having a portion thereof removed in the region where the density of magnetic flux is relatively small.

Preferably, a groove is formed in one face of the armature opposite to the face adjacent to the first pole surface. Since the magnetic flux mainly passes between the face of the armature facing the first pole surface and two faces of the armature adjacent to the mentioned face of the armature and facing the second pole surfaces, the groove does not substantially reduce the maximum magnetic flux of the magnetic circuit and yet substantially reduce the mass of inertia of the armature.

According to a certain aspect of the present invention, the armature is attached to the sheet spring by welding the free end of the sheet spring to the face of the armature facing the first pole surface by a laser beam aimed at the bottom surface of the groove of the armature.

Since the laser beam is not directly aimed at the sheet spring, no crater will be formed in the surface of the sheet spring facing the first pole surface, thereby preventing excessive magnetic resistance in the interface between the sheet spring and the first pole surface. Also, sheet spring is not excessively heated during the welding process and its mechanical strength is not substantially affected by the welding process.

BRIEF DESCRIPTION OF THE DRAWINGS

The present invention will now be shown and described in the following in terms of concrete embodiments thereof with reference to the appended drawings, in which.

DESCRIPTION OF THE PREFERRED EMBODIMENTS

Figure 1:
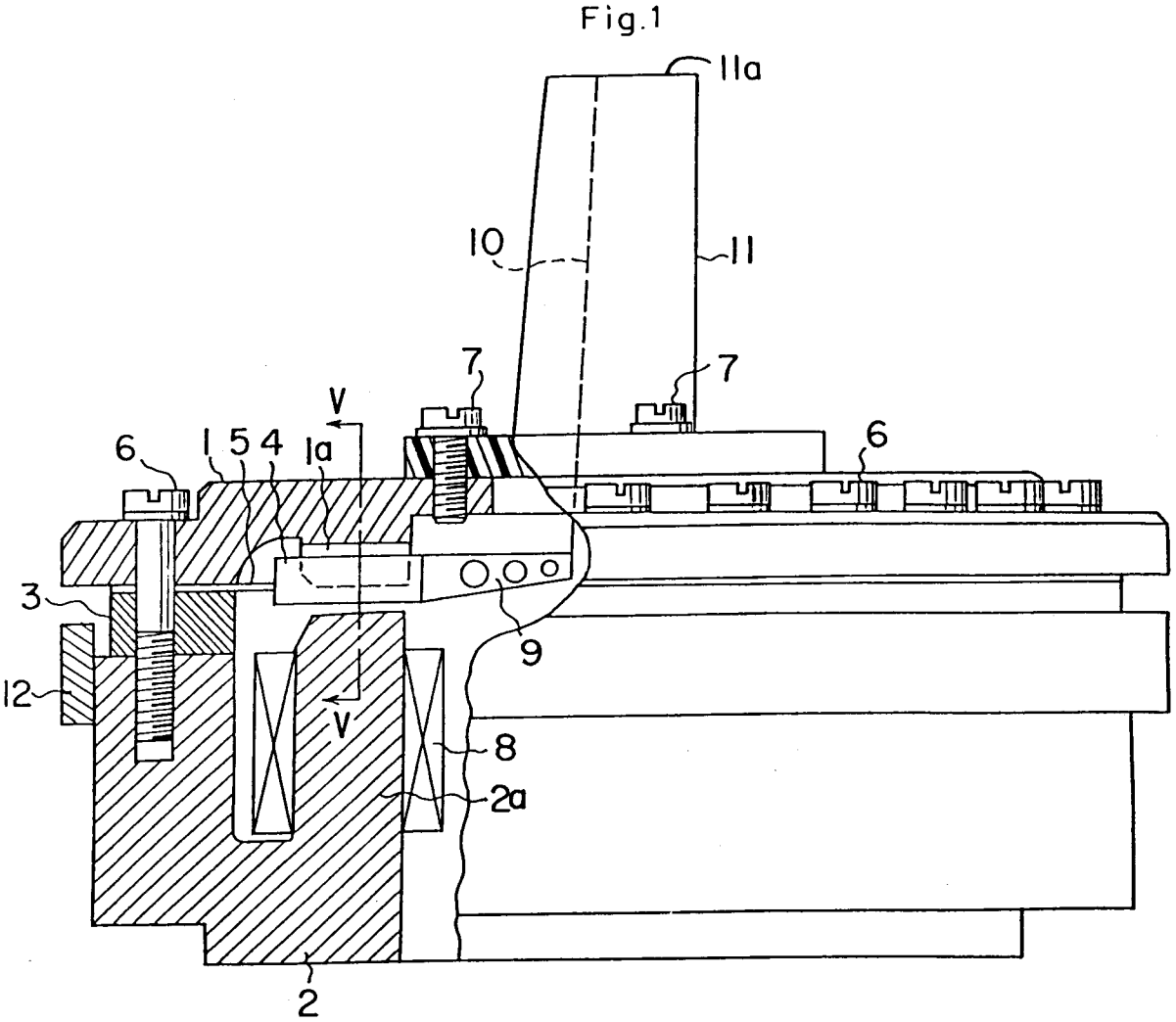
FIG. 1 is a partially broken-away side view of an embodiment of the dot matrix print head according to this invention.

FIG. 1 shows a general view of a print head according to this invention. A yoke 1 made of magnetically permeable material and a core member 2 having a plurality of cores 2*a* are attached to each other by a screws 6 interposing an annular permanent magnet 3 therebetween. Further, a sheet spring 5 is interposed between the annular permanent magnet 3 and the yoke 1 and an armature 4 is supported on the free end of the sheet spring 5. The other end of the armature 4 is securely attached to an arm 9 and an end of print wire 10 is securely attached to the fee end of the arm 9. The print wire 10 passes through a head nose 11 which is attached to the yoke 1 by screws 7 and the free end of the wire 10 reaches the free end surface of the head nose 11*a*. A solenoid 8 is fitted onto each of the cores 2*a* and the portion of the yoke 1 opposing the free end of the core 2*a* is provided with a groove 1*a* for receiving the armature 4.

Therefore, the armature 4 is placed in a magnetic gap defined by the free end surface of the core 2*a* and the two side surfaces of the groove 1*a*. When the solenoid 8 is deenergized, the armature 4 is biased towards the free end of the core 2*a* by the attractive force of the permanent magnet 3. When the solenoid 8 is energized so as to cancel the action of the permanent magnet 3, the armature 4 springs back away from the free end surface of the core 2*a* under the spring force of the sheet spring 5. Thus, the print wire 10 which is attached to the armature 4 by way of the arm 9 abruptly projects out from the free end surface 11*a* of the head nose 11 and produces a desired print by impacting upon a carbon ribbon and paper. A ring 12 fixedly attached to the outer circumferential surface of the core member 2 reduces the magnetic resistance of the permanent magnet 3 by partially magnetically short-circuiting the permanent magnet 3 so that the magnetic flux of the permanent magnet 3 may be canceled for driving the armature 4 away from the free end surface of the core 2*a* by supplying relatively small electric power to the solenoid 8 and, by adjusting the gap between the ring 12 and the outer periphery of the yoke 1, the action of the armature 4 is optimized for the particular voltage supplied to the solenoid 8.

Figure 2:
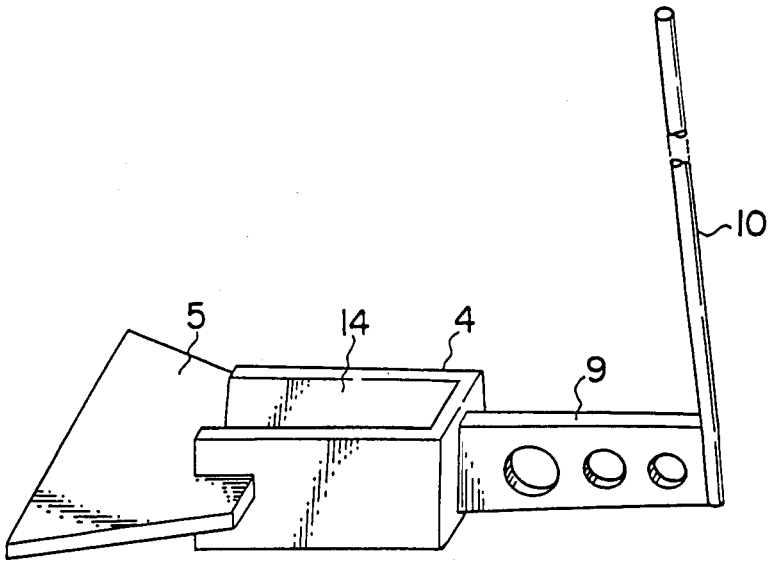
FIG. 2 is a perspective view of an assembly consisting of a sheet spring, an armature, an arm and a wire.
Figure 3:
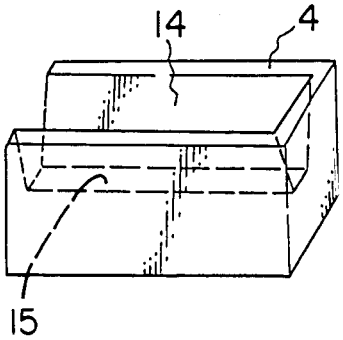
FIG. 3 is a perspective view of the armature.
Figure 4:
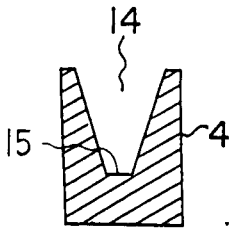
FIG. 4 is a cross-sectional view of the armature.
Figure 5:
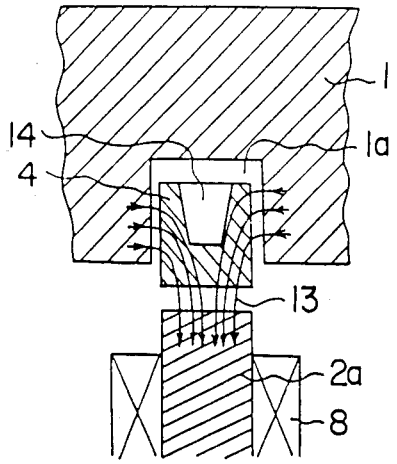
FIG. 5 is a sectional view taken along line V—V of FIG. 1.

FIG. 2 shows one of a number of assemblies which constitute the moving part of the print head. As can be seen from this drawing, a groove 14 is provided in the face of the armature 4 opposite to the face of the armature 4 facing the free end surface of the core 2*a*. As clearly shown in FIGS. 3 and 4, this groove 14 is trapezoidal in cross section with the broader base of the trapezoid being defined by the opening end of the groove 14. When such a groove is formed in the armature 4, because the groove 14 occupies the portion of the armature 4 where the magnetic flux density would be low even when the groove 14 were not present as indicated in FIG. 5 in which magnetic flux is represented by lines M, the magnetic flux passing through the armature 4 is not substantially affected by presence of this groove 14.

Figure 6:
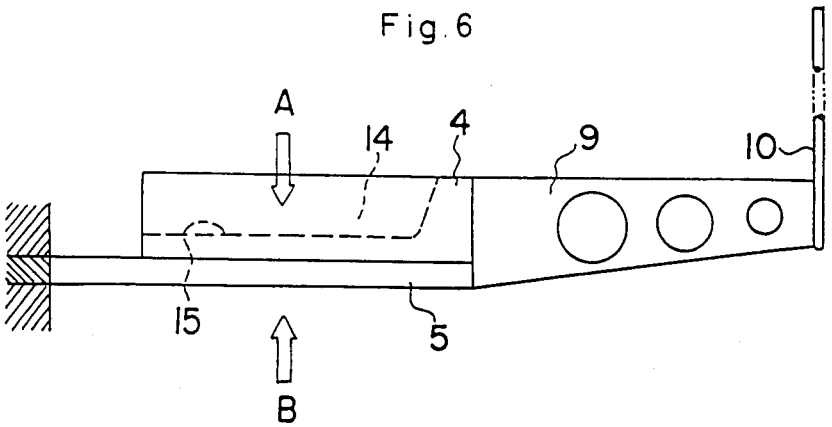
FIG. 6 is a side view of another embodiment of the armature assembly according to the present invention.

As shown in the embodiment of FIG. 6, the sheet spring 5 is attached to the face of the armature 4 facing the free end of the core 2 and the external surface of the sheet spring 5 is adapted to contact the the pole surface on the free end of the core 2*a*.

Referring further to the embodiment of FIG. 6, the sheet spring 5 is attached to the armature 4 by applying laser welding to the bottom surface 15 of the groove 14 as indicated by an arrow A. If this welding is performed from the side of the sheet spring 5 as indicated by an arrow B, craters will be formed in the external face of the sheet spring 15. Since this surface contacts the pole surface of the core 2*a* when the solenoid 8 is deenergized, it is important to reduce the magnetic resistance between the sheet spring 5 and the pole surface of the core 2*a* and such craters must be removed for satisfactory performance of the print head. On the other hand, when the laser welding is performed on the bottom surface of the groove 14 as indicated by the arrow A, no such craters will be formed in the sheet spring 5 and the magnetic performance of the armature assembly will not be affected.

Conventionally, SK-5 has been commonly used for such sheet springs for armature assemblies, but, when the sheet spring itself carries magnetic flux of relatively high density, materials such as N15 (Trademark: Tohoku Kinzoku K. K.) which is favorable in terms of both spring property and magnetic property is desired, and a sheet spring made of such material may be securely attached to the armature 4 by applying a laser beam from the bottom surface 15 of the groove 14 of the armature 4, without damaging the magnetic property of the material.

Figure 7:
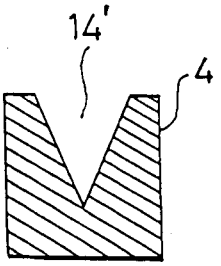
FIG. 7 is a cross-sectional view of another embodiment of the armature according to this invention.
Figure 8:
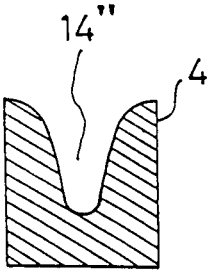
FIG. 8 is a cross-sectional view of yet another embodiment of the armature according to this invention.

FIGS. 7 and 8 show different embodiments of the armatures according to this invention. As shown in these drawings, the cross sectional shape of the groove may be other than trapezoid but may also be V-shaped as a groove 14′ shown in FIG. 7 and U-shaped as a groove 14″ as shown in FIG. 8.

Although the present invention has been shown and described with reference to the preferred embodiment thereof, and in terms of the illustrative drawings, it should not be considered as limited thereby. Various possible modifications and alterations could be conceived of by one skilled in the art to any particular embodiment, without departing from the scope of the invention. Therefore it is desired that the scope of the present invention should be defined not by any of the perhaps purely fortuitous details of the shown preferred embodiment, or of the drawings, but solely by the scope of the appended claims, which follow.

What is claimed is:

1. A dot matrix print head comprising a magnetic circuit including a permanent magnet, a magnetic core, a solenoid and a magnetic gap defined by a first pole surface and a pair of second pole surfaces extending orthogonally relatively the first pole surface, a sheet spring rigidly connected at one end to the magnetic core, an armature fixedly secured to a free end of the sheet spring, an arm connected to the armature, and a wire fixedly attached to the other end of the arm, the wire being axially driveable by the restoring force of the sheet spring by interruption and cancellation of the magnetic flux of the permanent magnet with the magnetic flux of the solenoid, the armature having an open cavity therein in the region where the density of magnetic flux is relatively small, said open cavity facing away from the free end of said sheet spring, said free end of the sheet spring being attached to the face of the armature opposite to the face in which the cavity is formed, said attachment being made by laser welding applied to the bottom surface of the cavity.

2. For use in a dot matrix print head, an armature assembly comprising:

an armature defining an open cavity having a bottom wall and two upstanding side walls;

sheet spring secured to the face of said bottom wall opposite said cavity by laser welding applied from the bottom surface of said cavity, said bottom wall separating said cavity from said sheet spring;

an arm secured to said armature; and a print wire secured to said arm.

3. A dot matrix print head comprising a magnetic circuit including a permanent magnet, a magnetic core, a solenoid, and a magnetic gap defined by a first pole surface and a pair of second pole surfaces extending orthogonally relatively to the first pole surface, a sheet spring rigidly attached at its one end, an armature fixedly secured to the free end of the sheet spring, an arm connected to the armature, and a wire fixedly attached to the other end of the arm, the wire being axially driveable by the restoring force of the sheet spring by interruption and cancellation of the magnetic flux of the permanent magnet with the magnetic flux of the solenoid, characterized in that:

the armature is reduced in mass by having a portion thereof removed in the region with the density of magnetic flux is relatively small, said removed portion comprising a groove formed in the face of the armature opposite to the face of the armature facing the first pole surface, the free end of the sheet spring being attached to the face of the armature opposite to the face in which the groove is formed, said attachment of said sheet spring being made by laser welding applied from the bottom surface of the groove.

* * * * *